US007996934B2

(12) United States Patent
Hay

(10) Patent No.: US 7,996,934 B2
(45) Date of Patent: Aug. 16, 2011

(54) APPARATUS FOR TRANSFERRING A PERSON FROM A WHEELCHAIR TO A FIXED SEAT

(75) Inventor: William Hay, Thebarton (AU)

(73) Assignee: Haycomp Pty Ltd (AU)

( * ) Notice: Subject to any disclaimer, the term of this patent is extended or adjusted under 35 U.S.C. 154(b) by 0 days.

(21) Appl. No.: 12/820,471

(22) Filed: Jun. 22, 2010

(65) Prior Publication Data

US 2010/0251481 A1 Oct. 7, 2010

Related U.S. Application Data

(63) Continuation of application No. 11/663,487, filed as application No. PCT/AU2005/001468 on Sep. 23, 2005, now abandoned.

(30) Foreign Application Priority Data

Sep. 24, 2004 (AU) ..... 2004905496

(51) Int. Cl.
*A61G 7/10* (2006.01)

(52) U.S. Cl. ..... 5/86.1; 5/81.1 R; 5/83.1; 5/85.1

(58) Field of Classification Search ..... 5/85.1, 5/86.1, 87.1, 89.1, 83.1, 81.1 R; 294/118
See application file for complete search history.

(56) References Cited

U.S. PATENT DOCUMENTS

| | | | | |
|---|---|---|---|---|
| 3,656,192 | A | 4/1972 | McGeoch | |
| 3,694,829 | A | 10/1972 | Bakker | |
| 4,003,479 | A | 1/1977 | Reyer | |
| 4,545,085 | A | 10/1985 | Feldt | |
| 6,192,534 | B1 | 2/2001 | Restivo | |
| 6,637,610 | B1 * | 10/2003 | Cheeseboro | 212/327 |
| 6,938,285 | B2 * | 9/2005 | Fernie et al. | 5/83.1 |
| 2005/0283907 | A1 * | 12/2005 | Dalton | 5/89.1 |

FOREIGN PATENT DOCUMENTS

| | | | |
|---|---|---|---|
| CA | 2094756 | A | 10/1994 |
| DE | 203 16 438 | U1 | 4/2004 |
| EP | 452 072 | A2 | 10/1991 |
| EP | 365 455 | B1 | 1/1993 |
| GB | 1 380 792 | A | 1/1975 |
| JP | 9-580 | A | 1/1997 |
| JP | 11-128275 | A | 5/1999 |
| JP | 2001-137297 | A | 5/2001 |
| JP | 2001-346839 | A | 12/2001 |
| JP | 2002-301109 | A | 10/2002 |
| JP | 2004-254999 | A | 9/2004 |
| WO | 01/01916 | A1 | 1/2001 |
| WO | 2005/041839 | A1 | 5/2005 |

* cited by examiner

*Primary Examiner* — Robert G Santos
*Assistant Examiner* — Brittany M Wilson
(74) *Attorney, Agent, or Firm* — Lerner, David, Littenberg, Krumholz & Mentlik, LLP

(57) ABSTRACT

Apparatus for transferring a person from a wheelchair to a fixed seat is disclosed, including a wheeled gantry that includes opposed front and rear legs and an upper portion connecting the legs, the gantry spanning a transfer station with a side entry for the wheelchair, and being capable of spanning the fixed seat; and a holding apparatus including a transfer seat and support frame, the transfer seat being sized to fit within the fixed seat; a lift for raising and lowering the transfer seat; and a support arm for rotating the support frame within the transfer station. The wheelchair can be wheeled into the transfer station, the person can be raised out of the wheelchair and rotated to face the front leg, the wheeled gantry can be moved to span the fixed seat, the person can be lowered into the fixed seat, and the wheeled gantry can be withdrawn.

19 Claims, 10 Drawing Sheets

APPARATUS FOR TRANSFERRING A PERSON FROM A WHEELCHAIR TO A FIXED SEAT

CROSS REFERENCE TO RELATED APPLICATIONS

This application is a continuation of U.S. application Ser. No. 11/663,487, filed on Aug. 16, 2007, which is a national phase entry under 35 U.S.C. §371 of International Application No. PCT/AU2005/001468, filed Sep. 23, 2005, published in English, which claims priority from Australian Patent Application No. 2004905496, filed Sep. 24, 2004, all of which are incorporated herein by reference.

FIELD OF THE INVENTION

The present invention relates to the transfer of a person from a wheelchair to a fixed seat. The present invention particularly relates to an apparatus that is useful in transferring a person from a wheelchair to a fixed seat in an aircraft, in a manner that permits the transfer to take place within the aircraft if desired.

BACKGROUND OF THE INVENTION

People in wheelchairs (whether they are in wheelchairs permanently or temporarily) face considerable difficulties when they travel. Often, they need to be moved from their own wheelchair to a passenger seat in an aircraft, train or other vehicle. Throughout this specification, the passenger seats in such forms of transportation will collectively be referred to as a 'fixed seat'. However, it is to be appreciated that the term 'fixed seat' is not to be limited only to passenger seats in aircraft or trains, but encompasses any seat that a person in a wheelchair may need to be transferred to (or from).

Currently, and referring particularly to what occurs in commercial airlines (to which much of the following description will be directed), a person in a wheelchair is often moved from their own wheelchair to an airlines' aisle chair', which is a specially designed wheelchair for use in narrow seating aisles of the type found in most commercial passenger aircraft. After being moved to an aisle chair (usually in the departure lounge, the concourse or the aerobridge of an airport), the person is wheeled down the seating aisle of the aircraft to the appropriate row, where flight attendants (or their personal attendants) assist them into their fixed seat.

This approach has several drawbacks. For instance, the process may require physical contact with the person's thighs, knees and underarms, which can be an unpleasant and awkward experience for both the person and the flight attendants.

In an effort to minimise the amount of such physical contact, use has been made of a personal sling placed under the person in the aisle chair. The presence of the sling then allows the attendants to lift the person via the sling into their assigned fixed seat. However, this does not remove the problem that the attendants are required to lift quite substantial loads without mechanical assistance, which of course presents an injury risk to the attendants.

In other circumstances, such as in a hospital, people are often moved about by means of quite large apparatus often referred to as 'invalid hoists', specifically to avoid the problems caused by nursing staff having to lift large loads without mechanical assistance. These invalid hoists are not though readily adaptable for use in the aircraft situation described above as they are invariably aimed at moving patients in prostrate or semi-reclined positions, and do not need to deal with the transfer of a person (seated upright) to the usually somewhat cramped space of an aircraft fixed seat. In this respect, the reasonably narrow gap between an aircraft seat and the seats immediately in front and behind presents special difficulties.

For example, U.S. Pat. No. 3,656,192 (issued to Robert R McGeoch in April 1972) describes a patient lift whereby a patient may be readily lifted from one horizontal support surface, such as a hospital bed, transported to a remote location and then placed upon a second horizontal support surface such as an operating table. The patient lift described in the McGeoch patent utilises a permanently attached, large, elongate, half-cylindrical cradle for receiving a prostrate patient, and is not intended for use in transferring people from wheelchairs, there being no mechanism for receiving a wheelchair therein. Indeed, the size and space considerations that are important in the aircraft use described above, render the patient lift of this US patent as being particularly un-useful.

Another example of a patient lift is the hoist and transporting apparatus described in U.S. Pat. No. 4,003,479 (issued to William J Reyer in January 1977). The Reyer patent describes an apparatus that is intended to be essentially permanently located, in that one apparatus will be arranged about a person's bed to assist them getting into and out of bed, another will be arranged about a person's bathtub to assist them getting into and out of the bath, and so on for whatever uses might be required. The apparatus is thus able to lift a person and then mechanically transfer them (by rotating an arm away from the apparatus) out of the apparatus. Again, the apparatus is extremely cumbersome and is not easily adapted for use in the confined spaces of a commercial aircraft.

More recently, an attempt has been made to develop an apparatus that adopts similar principles to the above patient lifts, but would be useful in the aircraft transfer situation described above. International patent application PCT/DK2004/000689 (published in May 2005 in the name of U-B-Let A/S) describes an apparatus for use in transferring a person from a wheelchair to an aircraft seat. The apparatus is sized and configured to fit over a wheelchair, to raise the person out of their wheelchair, to move along the seating aisle of an aircraft, and to span a person's assigned fixed seat so that the person can be placed into that seat.

However, the U-B-Let A/S apparatus itself has some drawbacks that render its use still somewhat difficult. For example, the lifting mechanism of the apparatus lifts a person up out of a chair or seat, but in doing so also moves them forward. This is due to the movement of the lifting arms as those lifting arms pivot upwardly about a horizontal axis. Likewise, when lowering the person, the pivoting of the lifting arms about the horizontal axis causes the motion of the person to be both downwards and backwards.

While this pivoting movement may be acceptable (although not necessarily desirable) when moving a person into or out of their wheelchair, it can present difficulties when lowering them into the fixed seat, as the motion moves them back into the seat. Also, and due to the cramped space provided between aircraft seats, any movement forward of the person when lifting them out of the fixed seat is likely to move them into contact with the back of the seat in front, which may require the re-location of the apparatus itself (backwards) to continue the lifting.

Also, the U-B-Let A/S apparatus is not adapted for operation within the cramped spaces of aircraft aisles, such as the usually narrow space in the entrance aisle of an aircraft. As can be seen, the use of the U-B-Let A/S apparatus relies upon the person being stationary in their wheelchair and the apparatus being moved over the wheelchair from the side, so that the person is facing forward upon entry to the apparatus. Because of this, the lifting of a person out of their wheelchair using the U-B-Let A/S apparatus must occur outside the aircraft and thus either in the departure lounge, the concourse, the aerobridge, or some other part of an airport, often in view of other people.

At the very least, after being loaded into the U-B-Let A/S apparatus, the person will usually suffer the ignominy of being wheeled past other passengers into the plane, within a rather cumbersome looking apparatus, attracting attention to themselves, which is often embarrassing for the person.

It is an aim of the present invention to provide an apparatus for transferring a person from a wheelchair to a fixed seat, which apparatus permits the person to remain in their own wheelchair, or at least in an aisle chair, for as long as possible before being located in that fixed seat. In a situation where the fixed seat is an aircraft seat, the aim is thus to provide an apparatus where the transfer from wheelchair to the apparatus can occur within the aircraft.

The discussion of the background to the invention herein is included to explain the context of the present invention. This is not to be taken as an admission that any of the material referred to was published, known, or part of the common general knowledge in Australia (or elsewhere) as at the priority date of any of the claims in this application.

Also, it is to be understood that while much of the following description will relate to operation of the apparatus in transferring a person from their wheelchair to an assigned fixed seat in an aircraft, the invention is not to be limited to only this use.

SUMMARY OF THE INVENTION

The present invention provides an apparatus for transferring a person from a wheelchair to a fixed seat, the apparatus including:

(a) a wheeled gantry that includes opposed, generally upright, front and rear legs and an upper portion connecting the legs, the gantry spanning a transfer station that has a side entry for the wheelchair, the gantry also being capable of spanning, in use, the fixed seat; and (b) a holding apparatus including a transfer seat and a transfer seat support frame, the transfer seat having a vertical axis, and being sized to fit, in use, within the fixed seat;

wherein the apparatus also includes a lift device for raising and lowering the transfer seat along its vertical axis, and means for rotating the transfer seat support frame within the transfer station.

The present invention further provides an apparatus for transferring a person from a wheelchair to a fixed seat, the apparatus including:

(a) a wheeled gantry that includes opposed, generally upright, front and rear legs and an upper portion connecting the legs, the gantry spanning a transfer station that has a side entry for the wheelchair, the gantry also being capable of spanning, in use, the fixed seat; and (b) a holding apparatus including a transfer seat and a transfer seat support frame, the transfer seat having a vertical axis and being sized to fit, in use, within the fixed seat;

(c) a lift device for raising and lowering the transfer seat along its vertical axis; and (d) means for rotating the transfer seat support frame within the transfer station;

whereby the wheelchair can be wheeled into the transfer station via the side entry, the person can be raised out of the wheelchair in the transfer seat and rotated to face the front, the wheeled gantry can be moved to span the fixed seat, the person can be lowered into the fixed seat and removed from the transfer seat, and the wheeled gantry can be withdrawn from spanning the fixed seat.

Further, the present invention provides a method for transferring a person from a wheelchair to a fixed seat, using the above apparatus, the method including the steps of:

(a) wheeling the wheelchair into the transfer station via the side entry;

(b) raising the person out of the wheelchair in the transfer seat;

(c) removing the wheelchair from the transfer station;

(d) rotating the transfer seat so that the person faces the front;

(e) moving the wheeled gantry to span the fixed seat;

(f) lowering the person into the fixed seat and removing the transfer seat; and (g) withdrawing the wheeled gantry from spanning the fixed seat;

wherein steps (a) and (b) occur without rotating the wheelchair with respect to the gantry.

During operation of the apparatus of the present invention, when a person is seated upright in the transfer seat, the vertical axis that contains the person's centre of gravity (which might often also be the vertical axis of the person's torso, or be at least very close to that vertical axis) will normally be generally coaxial with the vertical axis of the transfer seat. Therefore, once the person (in the wheelchair) has been moved into the transfer station, entering via the side entry and thus facing sideways upon entry (so that one of the person's shoulders is adjacent the front leg of the apparatus and the other shoulder is adjacent the rear leg of the apparatus), the raising and lowering of the person can occur (if required) without any (or with no substantial) lateral movement of the person to the side, rearward or forward within the transfer station.

The raising and lowering can thus occur directly upwardly and downwardly along the vertical axis of the transfer seat (and thus normally of the person's torso and normally through the person's centre of gravity), without the vertical axis itself moving. This controlled movement is advantageous during the operation of the apparatus in spaces that are conventionally very small and difficult to access, such as in a commercial passenger aircraft, particularly where the apparatus itself is preferably as small as possible, while still being strong and stable.

Also, the ability of the apparatus to remain stationary and accept a wheelchair from its side (allowed primarily due to the ability to subsequently rotate the person once they are lifted from their wheelchair), permits the apparatus to be located on board an aircraft, preferably at the junction of the entrance aisle and the seating aisle thereof, with the side entry of the transfer station directly accessible via the entrance aisle of the aircraft. A person may then be wheeled into the aircraft in their wheelchair, through the entrance aisle of the aircraft, and straight into the side entry of the apparatus, for subsequent operation of the apparatus in the manner described above.

This permits a person to remain in his or her own wheelchair until they enter the aircraft, rather than be transferred from their wheelchair in a more public place in an airport. It also avoids the embarrassment of being wheeled through an airport in a cumbersome looking apparatus of this type.

DETAILED DESCRIPTION

The description will now turn to a more specific description of various of the preferred features of the present invention.

As mentioned above, the holding apparatus includes the transfer seat and the transfer seat support frame. The transfer seat support frame preferably includes spaced apart side members configured to support therebetween and therebelow the transfer seat. The side members are preferably elongate and connected via a transverse member at a central location on each side member, the ends of the side members supporting therebetween and therebelow the transfer seat. In one form, at least one of the side members includes a gate portion that can be completely or partially removed in order to assist in removing the apparatus (and particularly the transfer seat support frame) from around a person once they are in their fixed seat.

The transfer seat will ideally be a sling that is reasonably lightweight yet strong and may be easily located under a person when they are seated in their wheelchair. The sling may have a built-in backrest but need not do so. The sling will ideally have no bulk so that it is does not extend beyond the person's legs, hips, waist, back and shoulders, so as to ensure that the person and the transfer seat together fit easily into the fixed seat, the fixed seat likely to be reasonably narrow and likely to have armrests that define the width thereof.

It will be appreciated that the above reference to the transfer seat having a vertical axis is a notional reference to the vertical axis of the transfer seat in use. It is likely to be easier to envisage this vertical axis with reference to the torso of a person within the transfer seat, or with reference to the person's centre of gravity and a vertical axis therethrough. Either way, in most situations, these vertical axes are likely to be coaxial, or at least so close to coaxial as to be substantially coaxial.

It should also be appreciated that the transfer seat will preferably be detachable from the transfer seat support frame so that, removed from the apparatus, it can be placed under a person in their wheelchair, and then be re-attached once the wheelchair has been wheeled into the transfer station. Similarly, once the person has been located in the fixed seat, the transfer seat can be detached to assist in removing it from under the person.

The holding apparatus, being the transfer seat and the transfer seat support frame, is preferably connected to the lift device via a support arm. In this respect, the lift device of the apparatus of the present invention preferably includes a guided member adapted to move up and down the front leg to thereby raise and lower the transfer seat. The guided member preferably includes a motorised actuator connected to a sleeve, the sleeve being slideable up and down the front leg.

Also as mentioned above, the apparatus of the invention includes means for rotating the transfer seat support frame within the transfer station. In one form of the invention, this means is provided by the connection of the support arm with the holding apparatus. Ideally, the support arm is connected to the transverse member of the transfer seat support frame, in a manner that permits rotation of the transfer seat support frame. In one form, this connection is via a rotary plate member provided on the transverse member, the plate member having a downwardly extending pivot pin received in a suitably sized bore at the end of the support arm.

With this in mind, the rotation of the transfer seat support frame is ideally such that the transfer seat will rotate from a wheelchair entry position through about 90° to a fixed seat transfer position, and vice-versa. It should be appreciated that in most embodiments, the axis of rotation of the transfer seat support frame will be coaxial with (or substantially coaxial with) the vertical axis of the transfer seat. Indeed, it is preferred that the apparatus be configured such that these two axes are coaxial, which provides the apparatus with extra stability during operation. However, due to people typically having very different body shapes and sizes, in use it might be found that (even with the apparatus designed and configured to achieve the coaxial relationship) these two axes are not precisely coaxial.

In one form of the invention, the support arm that connects the holding apparatus to the lift device is rigidly connected to the sleeve of the guided member, and can be referred to as a 'rigid support arm'. In this form, and due to the rigid connections described above, movement of the sleeve up and down the front leg translates directly to movement of the transfer seat up and down along its vertical axis.

In another form of the present invention, the support arm may be pivotably connected to the sleeve of the guided member to allow movement of the transfer seat axis within the transfer station, towards or away from the front leg, allowing the support arm (in this form) to be referred to as a 'swinging support arm'. The pivoting of the swinging support arm is about a vertical axis.

It is not envisaged that this embodiment would be utilised during operation of the apparatus, but rather would allow for the apparatus to be adjusted before operation, primarily in order to suit the size of a person's wheelchair and thus the position that the person will adopt within the transfer station. Again, to assist in ensuring that the apparatus is stable, it may be useful to locate the wheelchair so that the person's centre of gravity is reasonably central in the apparatus. Thus, it may be necessary to use the swinging support arm to locate the vertical axis of the transfer seat further towards the rear of the transfer station than towards the front.

However, the presence of the swinging support arm also makes it possible to deliberately move the vertical axis of the transfer seat during operation of the apparatus, such as might be useful in some situations when lowering a person into a fixed seat due to the angle of incline of the backrest of a fixed seat, or due to the particular circumstances of the person being transferred.

Finally, it is preferred that at least the front leg of the gantry will be a single upright member, off-set to the side of the apparatus such that an open space is left at the front of the transfer seat during operation. More preferably, both legs will be configured in this way and will be off-set to one side of the apparatus. A person's legs or feet may then extend into the open space adjacent the front leg when the person is located in the transfer seat in the transfer station, and when facing forward in the apparatus. This is particularly useful when operating the apparatus in the normally cramped confines of an aircraft, and avoids the gantry having to be configured to be able to span two fixed seats.

Of course, this means that when the apparatus is operated to transfer a person to an aisle seat of an aircraft, the front leg effectively remains in or adjacent to the aisle and is not located between fixed seats in a space that is often very narrow. By configuring the front leg in this manner, and thus ensuring that the front leg remains, in use, on the aisle side of the person's legs, the front leg does not need to be withdrawn through that narrow space between seats and past the person's legs after the person has been transferred to the fixed seat.

If the preferred feature of the off-set legs is adopted in an embodiment of the invention, it will be appreciated that the apparatus of that embodiment will then be either 'right-handed' or 'left-handed'. For example, if the front leg is off-set to the left of the apparatus (viewed when seated in the transfer seat and facing forward of the apparatus), then the apparatus will be most useful for transferring a person to an aisle seat in an aircraft on the starboard (or right) side of the aircraft. Off-setting the front leg to the right of the apparatus will make the apparatus particularly suited for use in transferring a person into a port (or left) side aisle seat.

BRIEF DESCRIPTION OF THE DRAWINGS

The present invention will now be described with reference to various preferred embodiments. However, it is to be understood that the following description is being provided simply to illustrate examples of how the inventive concepts generally described above might be implemented. The following discussion of the preferred embodiments is thus not to limit the generality of the above discussion of the invention.

DETAILED DESCRIPTION

Figure 1:
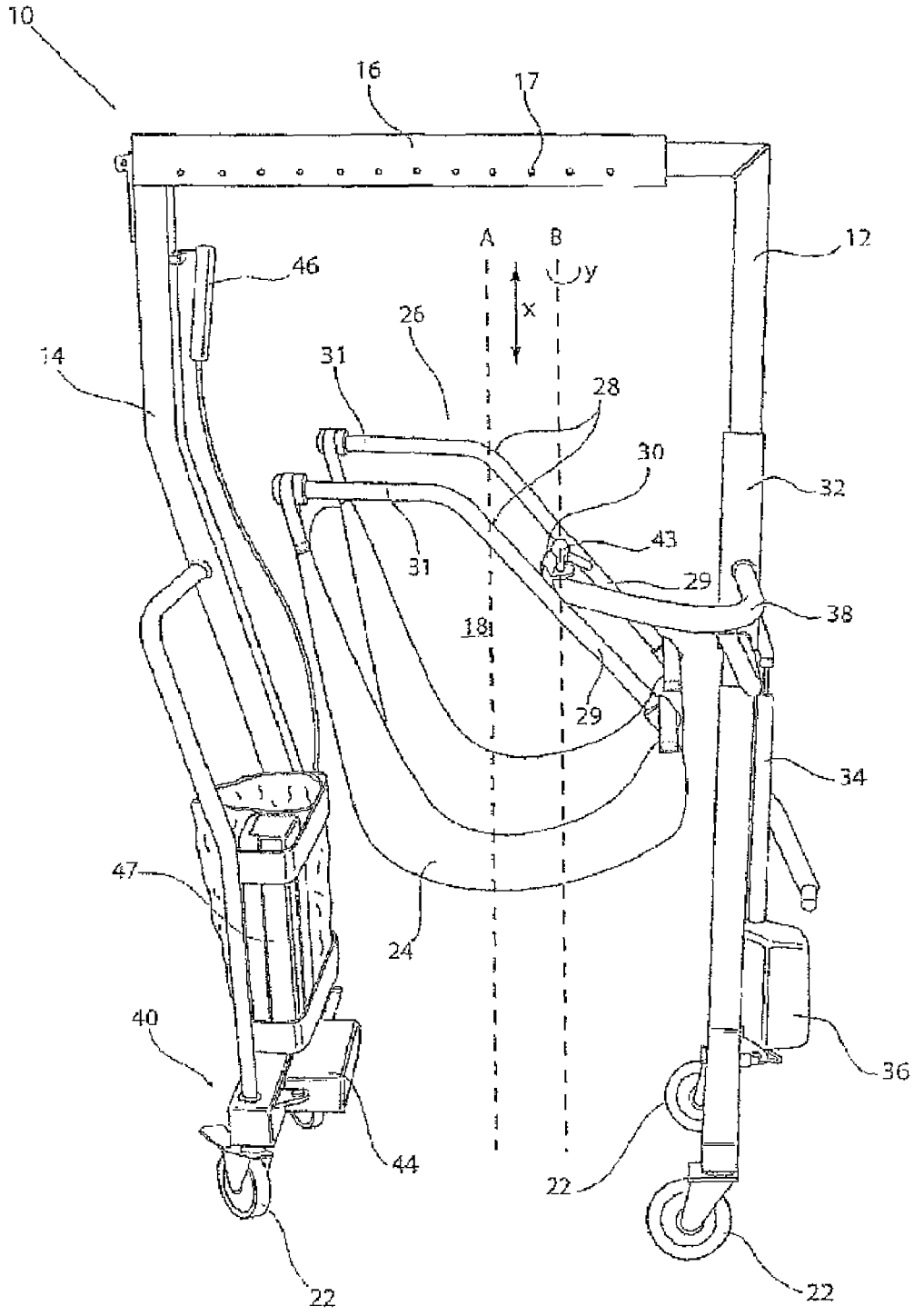
FIG. 1 is a side view of an apparatus in accordance with a first embodiment of the present invention, the apparatus being for the transfer of a person from a wheelchair to a fixed seat in an aircraft.
Figure 2:
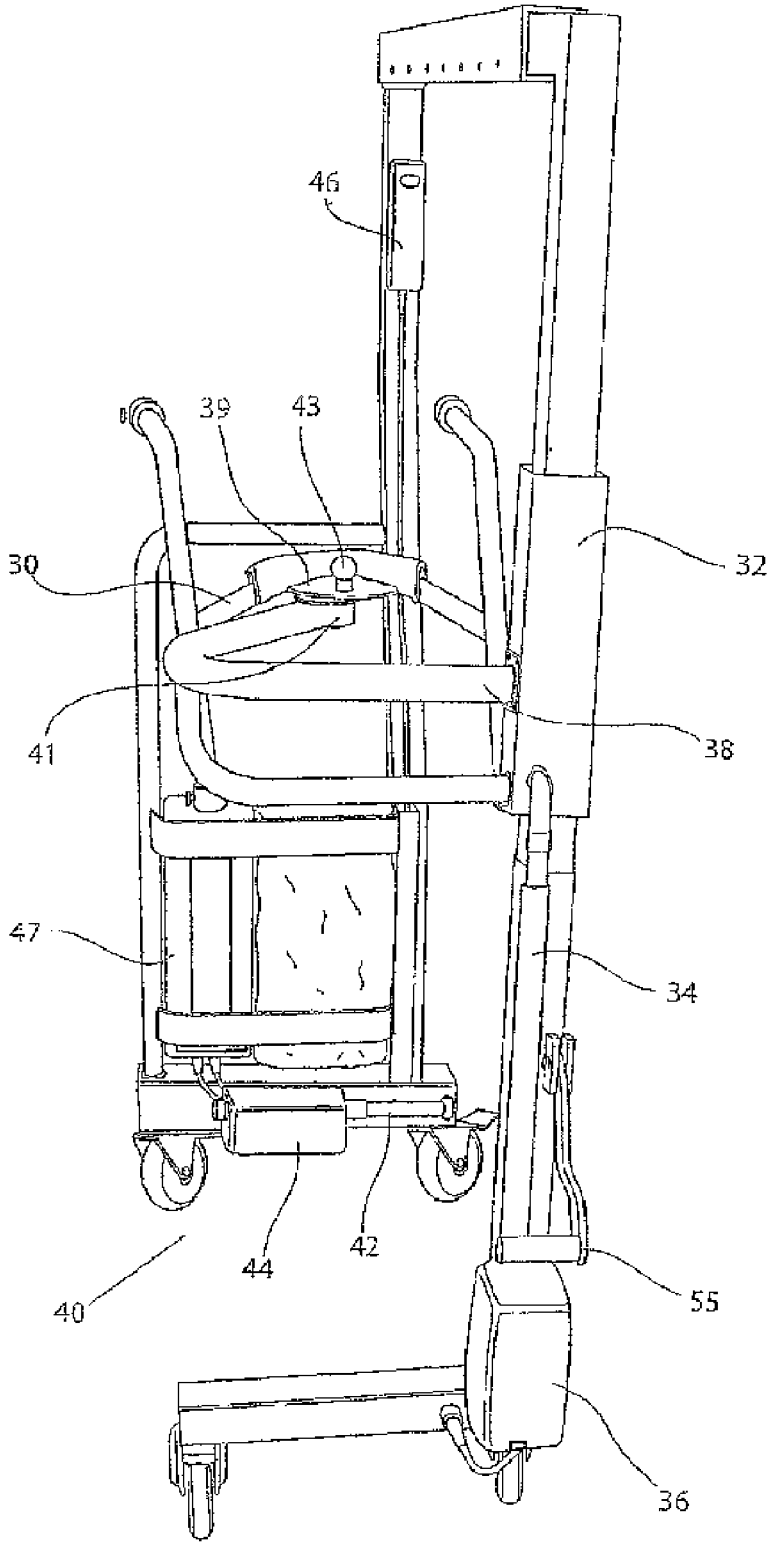
FIG. 2 is an end view of the apparatus of FIG.1.

Illustrated in FIGS. 1 and 2 is an apparatus 10 for transferring a person from a wheelchair (not shown) to a fixed seat (not shown in FIGS. 1 to 4, but shown in FIGS. 5 to 10 as a fixed seat 20). The apparatus 10 includes a wheeled gantry that includes a front leg 12, a rear leg 14, and an upper portion 16 connecting the front and rear legs (12,14). The front and rear legs (12,14) both include wheels in the form of pairs of castors 22 that allow the gantry to be wheeled in any direction.

It will be appreciated that while the front and rear legs (12,14) are each shown as being primarily single member legs, the legs may be provided by two or more upright members as necessary. Having said that, for reasons that will be explained below, it is preferred to have at least the front leg 12 as a single upright member, off-set to the side (in this case the left side, when viewed from the transfer seat and when facing forward) of the apparatus 10 as can be seen best in FIG. 2, leaving an open space in front of the transfer seat 24 during operation. As mentioned above (and as will be further explained below), this makes the apparatus 10 ideal for the transfer of a person to a starboard side aisle seat in an aircraft.

In relation to the reference in this specification to 'forward', the end of the apparatus 10 that includes the front leg 12 is regarded as the front of the apparatus 10, and thus a reference to 'forward' is a reference based on that end of the apparatus 10 being the front. Similarly, a reference to the 'left' or 'right' sides of the apparatus is made with respect to someone seated in the transfer seat facing forward.

The upper portion 16 of the gantry may be provided as a multiple member portion, perhaps if it is desired to provide the apparatus 10 with extra strength. Also, while the front leg 12 is shown as a generally straight and generally upright leg, the rear leg 14 is shown with a shape that, whilst being generally upright, is not straight but conforms generally to the shape of the back of the fixed seat 20. This shape has been found to work best with fixed seats of the type normally found in commercial passenger aircraft.

The front and rear legs (12,14) and the upper portion 16 together provide the bridge-like gantry that spans a transfer station, which transfer station will now be described.

The transfer station is generally indicated by the reference numeral 18 (in FIGS. 1,3 and 5), although the transfer station 18 is a notional space that is virtually the entire space between the front and rear legs (12,14), and below the upper portion 16 to the ground. The transfer station 18 is the space that will receive the wheelchair and is the space within which the person in the wheelchair will be raised and rotated in accordance with the invention. It must thus be suitably sized for these actions.

In this respect, where reference is made throughout this specification to something occurring 'within' the transfer station 18 (such as the rotation of the transfer seat), it should be appreciated that parts of the transfer seat 24 (and indeed the person located in the transfer seat 24) may actually project outside the obvious boundaries of the apparatus 10 and thus outside what might generally be regarded as the transfer station 18. Irrespective of this, the rotation is still regarded, for the purposes of this specification, as occurring predominantly within the transfer station 18.

The gantry is not only required to span a suitably sized transfer station 18, but is also required to span, in use, the fixed seat 20 to which the person is being transferred. In this respect, the gantry is ideally sized such that the rear leg 14 stands closely behind the back of the fixed seat 20, while the front leg 12 stands, in use, in front of the fixed seat 20 between it and the back of the seat in front of it. In some situations, the location of the front leg 12 a short distance in front of the fixed seat 20 may provide enough room for the front leg 12 of the apparatus 10 to be withdrawn from between the seats (and past the person's legs) once the person is seated in the fixed seat 20, such as might be possible where the apparatus is used to transfer a person to a business class or first class seat where larger legroom is typically available.

Of course, and as mentioned above in relation to the off-setting of the front leg 12, as the space between most economy class seats in an aircraft may not actually permit the front leg 12 to be withdrawn from between the seats (and past a person's legs) once the person is seated in the fixed seat 20, the apparatus 10 may only be useful for transferring people to seats on one side of the aircraft in economy class.

Figure 3:
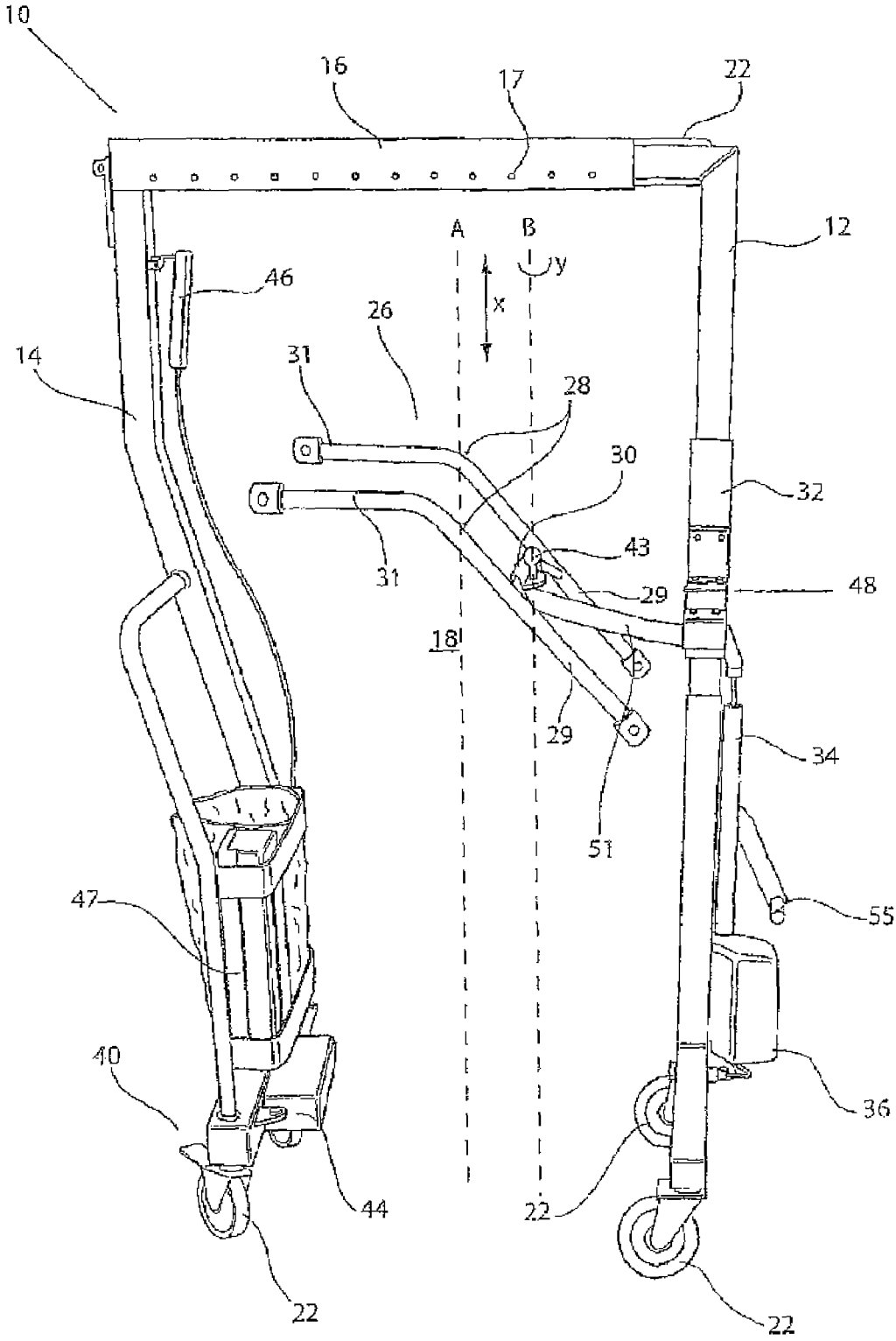
FIG. 3 is a side view of an apparatus in accordance with a second embodiment of the present invention, the apparatus again being for the transfer of a person from a wheelchair to a fixed seat in an aircraft.
Figure 4:
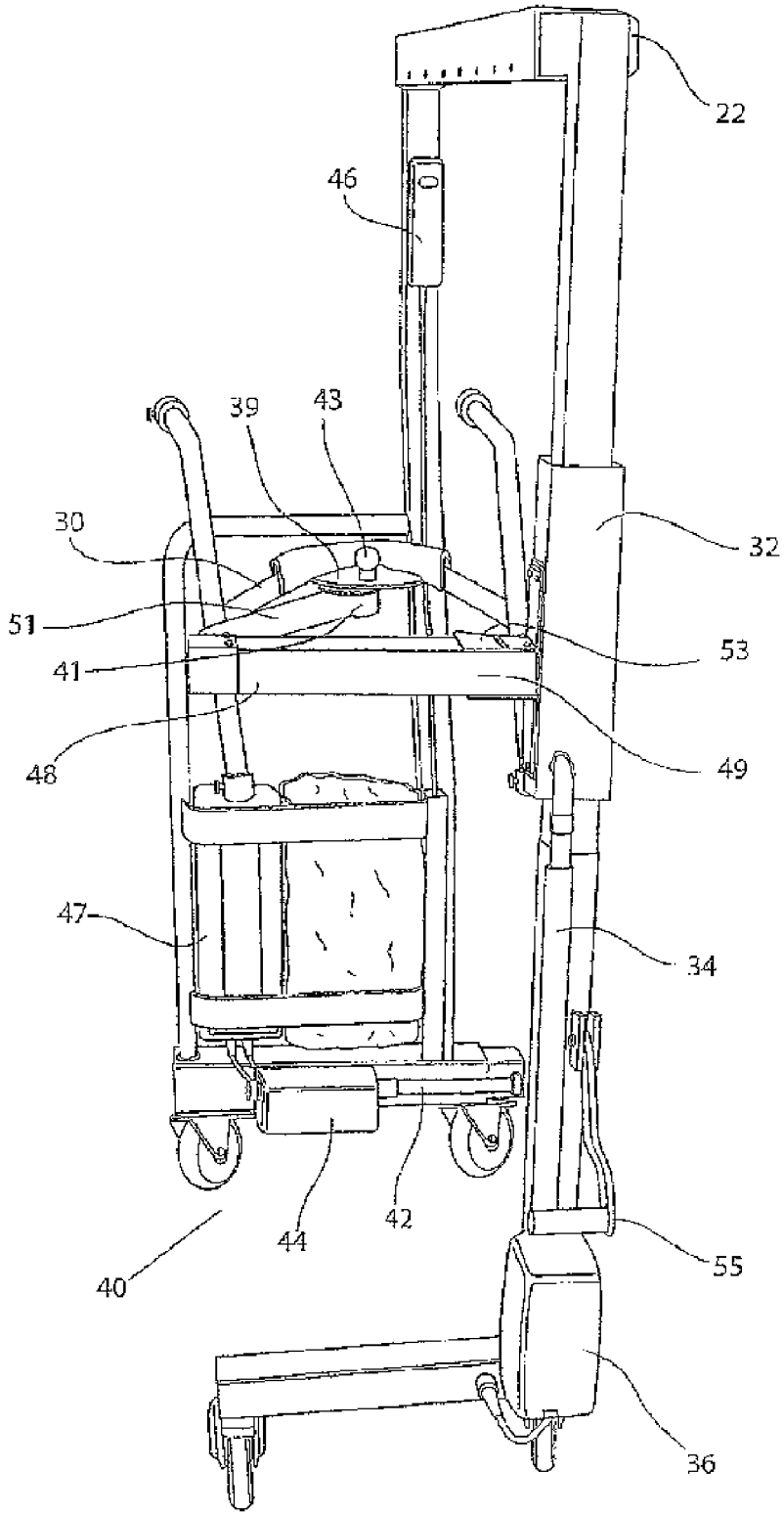
FIG. 4 is an end view of the apparatus of FIG. 3.

Indeed, given that the spacing between fixed seats will be different for different seating configurations (and different classes) in different aircraft, it is preferable for the distance between the front and rear legs (12,14) of the apparatus 10 to be adjustable. Thus, the upper portion 16 of the gantry is preferably telescoping so that the upper portion 16 can be manually shortened or lengthened as necessary, with a suitable detent-type securing mechanism 17 utilised to secure the position of the upper portion 16. Of course, and as can be seen in the embodiment of FIGS. 3 and 4, this adjustment can be provided by a motorised actuator 22 (only partially visible) if desired.

Returning to the apparatus 10 illustrated in FIGS. 1 and 2, the apparatus 10 also includes a holding apparatus that includes a transfer seat 24 and a transfer seat support frame 26. The transfer seat support frame 26 includes spaced apart side members 28 that are elongate and that each have inclined portions 29 and generally horizontal portions 31. A transverse member 30 that extends between the side members 28 at about a central location thereof secures the side members 28 to each other. At the ends of the side members 28, the transfer seat 24 can be detachably secured, either by being hung from hook members or by being secured by a suitable locking mechanism. This arrangement provides for a reasonably balanced support for a person within the transfer seat 24, such that they can be supported generally below and between the side members 28 of the transfer seat support frame 26.

Also, at least one of the side members 28 may include a gate portion (not separately identified in the Figures) that can be completely or partially removed in order to assist in removing the apparatus 10 (and particularly the transfer seat support frame 26) from around a person once they are in their fixed seat. For example, it is possible to hinge one of the horizontal portions 31 of a side member 28 to provide such a gate portion.

The transfer seat 24 is shown having a generally vertical axis A, although this vertical axis A is likely to be the vertical axis of the torso of a person seated in the transfer seat 24, which (as explained above) will most likely also be an axis that lies on the person's centre of gravity. As will be explained below, one advantage of an apparatus according to this embodiment of the invention (particularly of the apparatus 10 shown in FIGS. 1 and 2) is that it can raise and lower the transfer seat 24 (and thus the person in the transfer seat 24) along that vertical axis A, as indicated by the arrow X, without the axis A being forced to move either towards the rear leg 14 or the front leg 12 during the raising and lowering.

Indeed, the apparatus 10 includes a lift device that is able to raise and lower the transfer seat 24 along its vertical axis A. The lift device includes a guided member 32 in the form of a sleeve mounted for sliding movement along (up and down) the front leg 12. The guided member 32 is connected to and driven by an electric actuator 36.

A support arm 38 is shown rigidly secured to the guided member 32 at one end, and to the transverse member 30 of the transfer seat support frame 26 at its other end, allowing the driven movement of the guided member 32 up and down the front leg 12 to translate to the raising and lowering of the transfer seat 24 along (up and down) its vertical axis A. Also, the support arm 38 is shown having a generally U-shape in order to allow for the movement of the side members 28 of the transfer seat support frame 26 when it rotates, as will now be described.

The support arm 38 is attached to the transverse member 30 of the transfer seat support frame in a manner that permits the transfer seat support frame to be rotated about 90°, from a wheelchair entry position (shown and described below in relation to FIG. 6) to a fixed seat transfer position (shown and described below in relation to FIGS. 7 to 9), and then back again, during operation. Ideally, the rotatable connection between these two members permits the transfer seat support frame 26 to be locked in various positions as required, such as at the wheelchair entry position and also at the fixed seat transfer position.

In the embodiment illustrated in FIGS. 1 and 2, and indeed also in the embodiment illustrated in FIGS. 3 and 4, this rotatable connection is provided by a rotary plate member 39 (partially visible in FIG. 2) provided on the transverse member 30, the plate member 39 having a downwardly extending pivot pin (not shown) received in a suitably sized bore 41 (also partially visible in FIG. 2) at the end of the support arm 38.

During operation, when it is required to rotate the transfer seat support frame 26, the locking knob 43 is released and the transfer seat frame 26 is rotated clockwise (looking down on the plate member 39 from above) such that the horizontal portions 31 of the side members 28 are towards the left of the apparatus 10 (to the right of the page in FIG. 2) and are open towards the side entry of the apparatus 10. This is the rotation of the transfer seat support frame 26 that would take the apparatus from the position shown in FIG. 5 to the position generally shown in FIG. 6 (ignoring the presence of the wheelchair).

Figure 6:
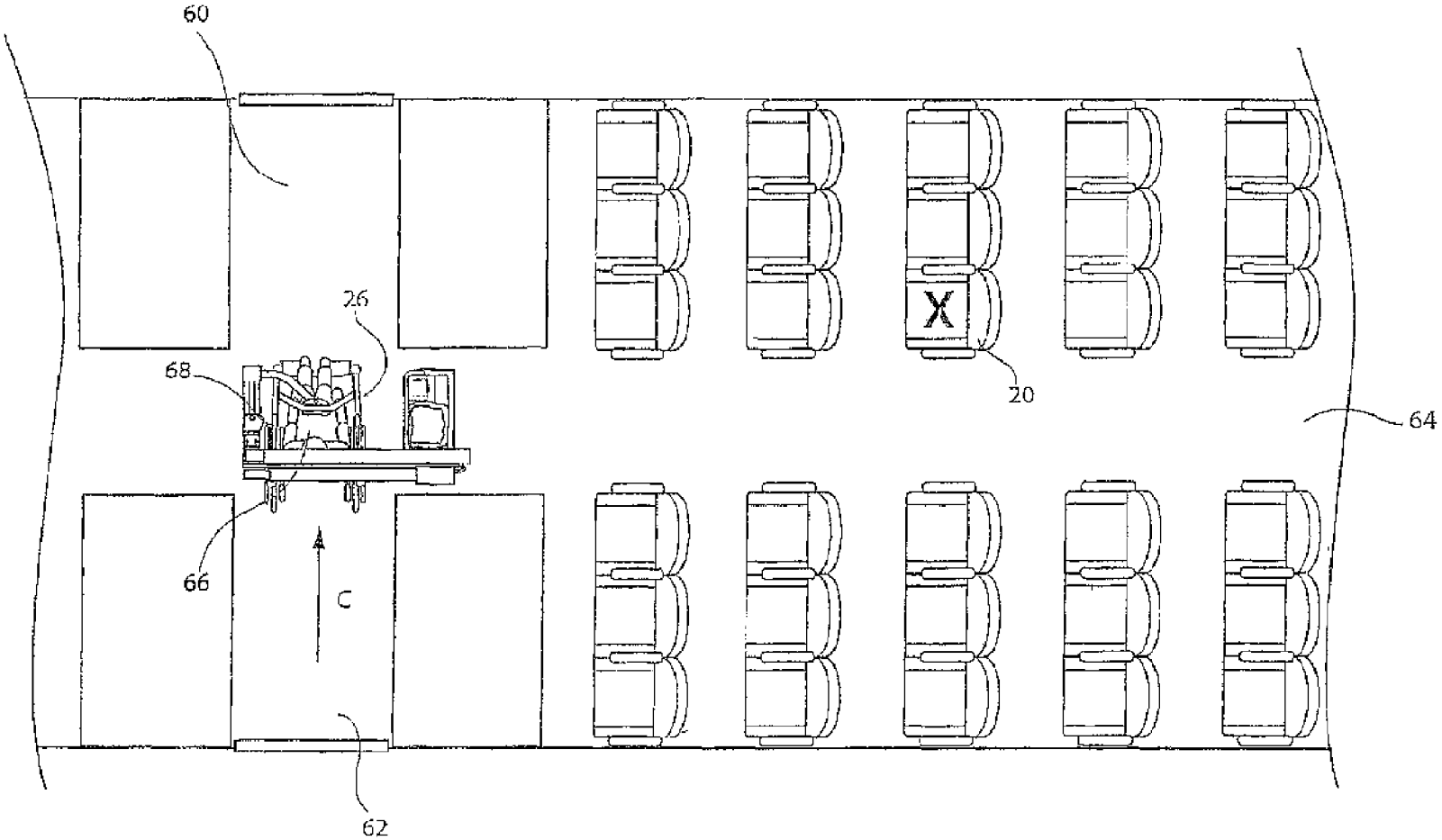
Figure 7:
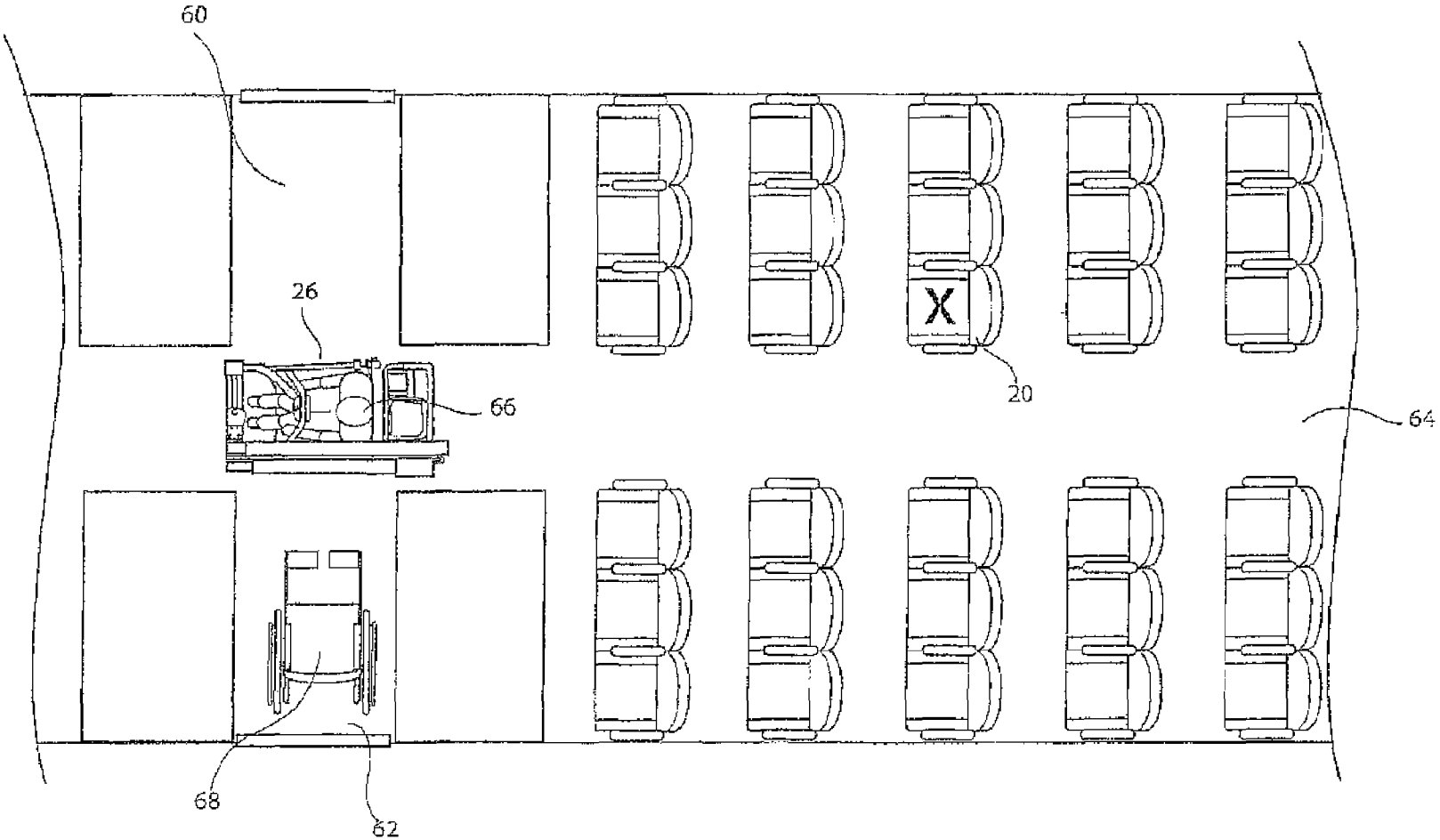

The transfer seat support frame 26 thus rotates about the vertical axis B of the rotary plate member 39 (in the direction of arrow Y in FIG. 1), so that a person sitting in the transfer seat 24, raised above their wheelchair (such as shown in FIG. 6), may be rotated from facing (initially) sideways to sitting facing the front of the apparatus 10 (such as shown in FIG. 7). During this rotation, the gantry can remain stationary, and the person remains generally within the transfer station 18.

However, and as mentioned above, in many embodiments it will generally be preferred to attempt to configure the apparatus 10 in a manner that minimises the distance between axis A and axis B. Indeed, ideally, these two axes will be precisely or substantially coaxial, in order to maximise the stability of the apparatus 10 during operation.

Finally with regard to FIGS. 1 and 2, reference is made to the rear leg, wheel-extending base 40, which is provided in the event that extra stability is required for particular uses. The extending base includes a telescopically extending arm 42 operated by a motorised actuator 44. In this respect, the apparatus 10 is also shown provided with a single controller 46 secured thereto in an easily accessible location, for operation of all of the powered functions of the apparatus 10, together with a suitable battery pack 47.

Turning to a brief description of the embodiment illustrated in FIGS. 3 and 4 (and before turning to a description of the operation of the apparatus in FIGS. 5 to 10), specific reference will only be made to the two differences between the first and second embodiments.

Firstly, the operation to extend the upper portion 16 is shown in FIG. 3 as being automated by the provision of a motorised actuator 22 (only partially visible) as mentioned above. Secondly, the support arm 38, shown in the embodiment of FIGS. 1 and 2 as having a rigid connection to the guided member 32, in FIGS. 3 and 4 has a pivoting connection as provided by a swinging support arm 48. The swinging support arm 48 includes a major pivoting portion 49 and a minor pivoting portion 51. The major pivoting portion 49 is pivotally secured at one end to the guided member 32 and at its other end to the minor pivoting portion 51, via a locking plate 53. The locking plate 53 permits the swinging support arm 48 to be locked in a variety of positions as necessary.

As described above, the main benefit in including a swinging support arm 48 in the apparatus 10 is to permit adjustment required for different sized wheelchairs or for different sized people. In order to improve the stability of the apparatus 10, it may be useful to be able to locate the person's centre of gravity reasonably centrally within the transfer station 18, and thus to permit entry of the wheelchair centrally of the transfer station 18.

Finally with regard to the embodiments shown in FIGS. 1 to 4, a handle 55 is shown that can be used to lift the apparatus 10, such as may be needed when moving the apparatus 10 into an aircraft from an aerobridge.

The operation of the apparatus 10 will now be generally described in relation to the sequential illustrations of FIGS. 5 to 10. While the following description will refer to various parts of the apparatus described above in FIGS. 1 to 4 (either embodiment being suitable for use in the following manner, although the embodiment of FIGS. 3 and 4 being shown), and will use the reference numerals of those parts as used above, not all of those parts will be visible in the schematics of FIGS. 5 to 10.

Figure 5:
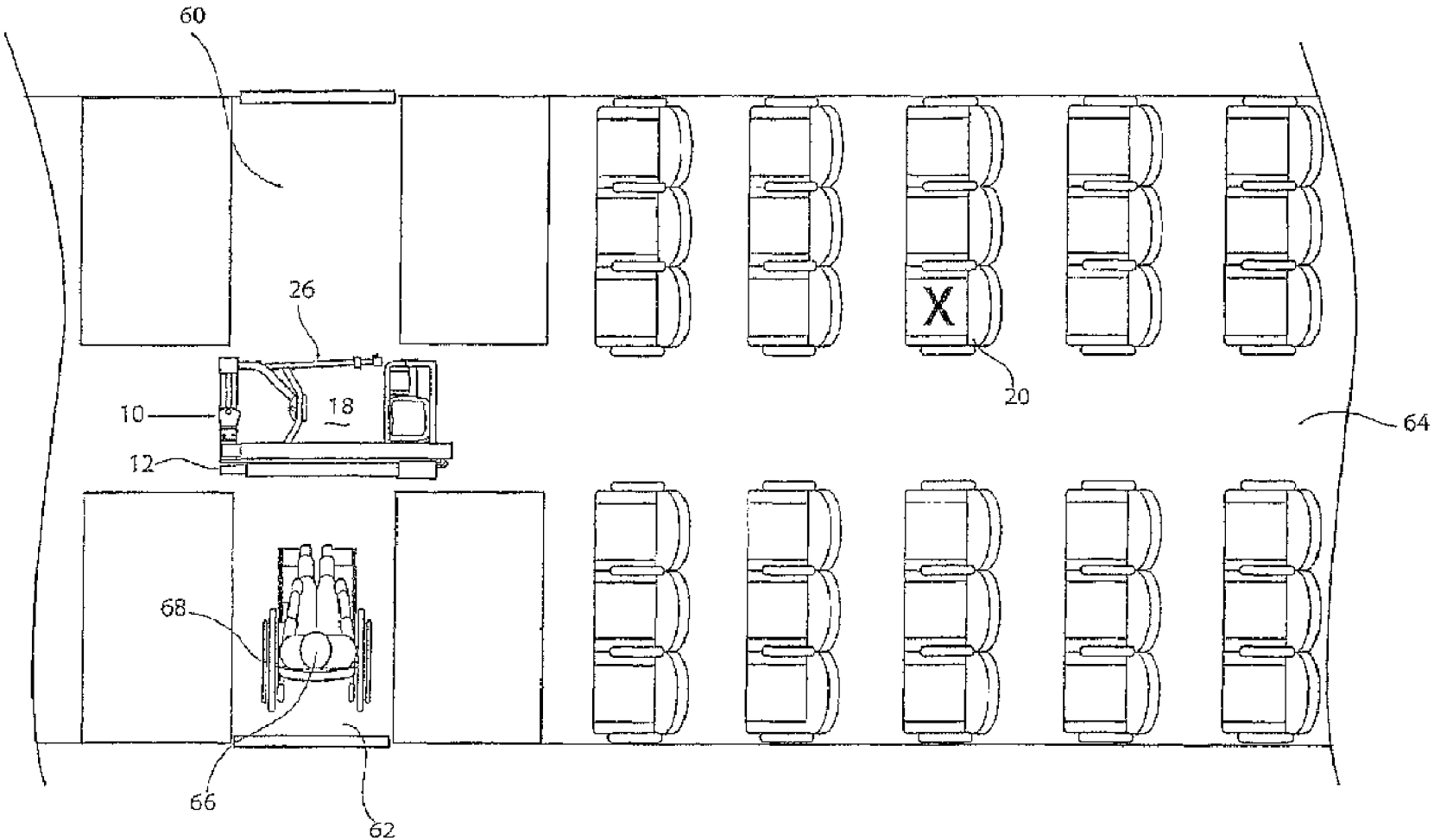
FIGS. 5 to 10 are schematic sequential illustrations showing the operation of the apparatus of FIGS. 3 and 4 in transferring a person from a wheelchair to a fixed seat in an aircraft.

FIG. 5 schematically shows an aircraft having a galley 60 at the left hand side of the page (towards the front of the aircraft) and passenger seats at the right hand side of the page (towards the rear of the aircraft). The aircraft includes an entrance aisle 62 and a seating aisle 64. It should be appreciated that the proportions of seat sizes and spacing, and aisle sizes and spacing has not been drawn to scale. It should also be appreciated that each of the schematic illustrations of FIGS. 5 to 10 show the same general features.

Shown located in the entrance aisle 62 in FIG. 5 is a person 66 in a wheelchair 68. Provided that the person's wheelchair fits within the entrance aisle 62, and provided that a particular airline's policies permit it, the wheelchair 68 will be the person's own wheelchair. However, the wheelchair 68 may be an airline wheelchair, which is typically somewhat narrower than a normal wheelchair and is usually referred to as an 'aisle chair'. The fixed seat 20 that the passenger is being transferred to is marked with an X.

In FIG. 5, the wheelchair 68 has been wheeled onto the aircraft via (normally) an aerobridge, into the entrance aisle 62, and is ready to be wheeled into the transfer station 18 of the apparatus 10 in the direction of arrow C (in FIG. 6). The apparatus 10 of the invention is already located at the junction of the entrance aisle 62 and the seating aisle 64, such that the (off-set) front leg 12 is towards the front of the aircraft. The transfer seat support frame 26 is shown not yet rotated so that it is facing towards the wheelchair 68 in the direction of the entrance aisle 62. However, before the wheelchair 68 is moved into the transfer station 18, the transfer seat support frame 26 will be rotated such that its side members 28 become parallel to the entrance aisle 62 but transverse to the seating aisle 64.

The person 66 in the wheelchair 68 will have placed under them, or will already have had placed under them, a transfer seat 24 that is able to attach to the side members 28 of the transfer seat support frame 26 in the manner described above. Ideally, the transfer seat 24 will be a reasonably lightweight (and non-bulky) sling, such that the raising of the sling also permits the raising of the person 66.

In FIG. 6, the wheelchair 68 has entered the transfer station 18 of the apparatus 10 from the side of the transfer station 18. Given the ability of the apparatus 10 to subsequently rotate the person 66 to align them with their fixed seat 20, the wheelchair 68 is able to wheeled directly into the transfer station 18 from the side. The transfer seat 24 is then attached to the side members 28 of the transfer seat support frame 26 and the person 66 is raised out of their wheelchair 68 by the lifting device in the manner described above. The lifting occurs substantially vertically, and along the vertical axis of the transfer seat 24 (axis A in FIG. 1), which will generally be the vertical axis of the person's torso and also should have close to it (or on it) the person's centre of gravity. The lifting thus essentially raises the person straight up, without any movement forwards, backwards or to the side.

In FIG. 7, the wheelchair 68 has been withdrawn from under the person 66 (once they have been raised in the transfer seat 24 and are clear of the wheelchair 68) and moved back into the entrance aisle 62. Also, the transfer seat support frame 26 has been rotated within the transfer station 18 to face the person 66 towards the front of the apparatus 10 and the front of the aircraft. Although in FIG. 7 the person's legs are shown entirely within the transfer station 18 (and thus the apparatus 10), it is quite likely that the persons legs will extend further forward and into the open space adjacent the off-set front leg 12 as described above.

Figure 8:
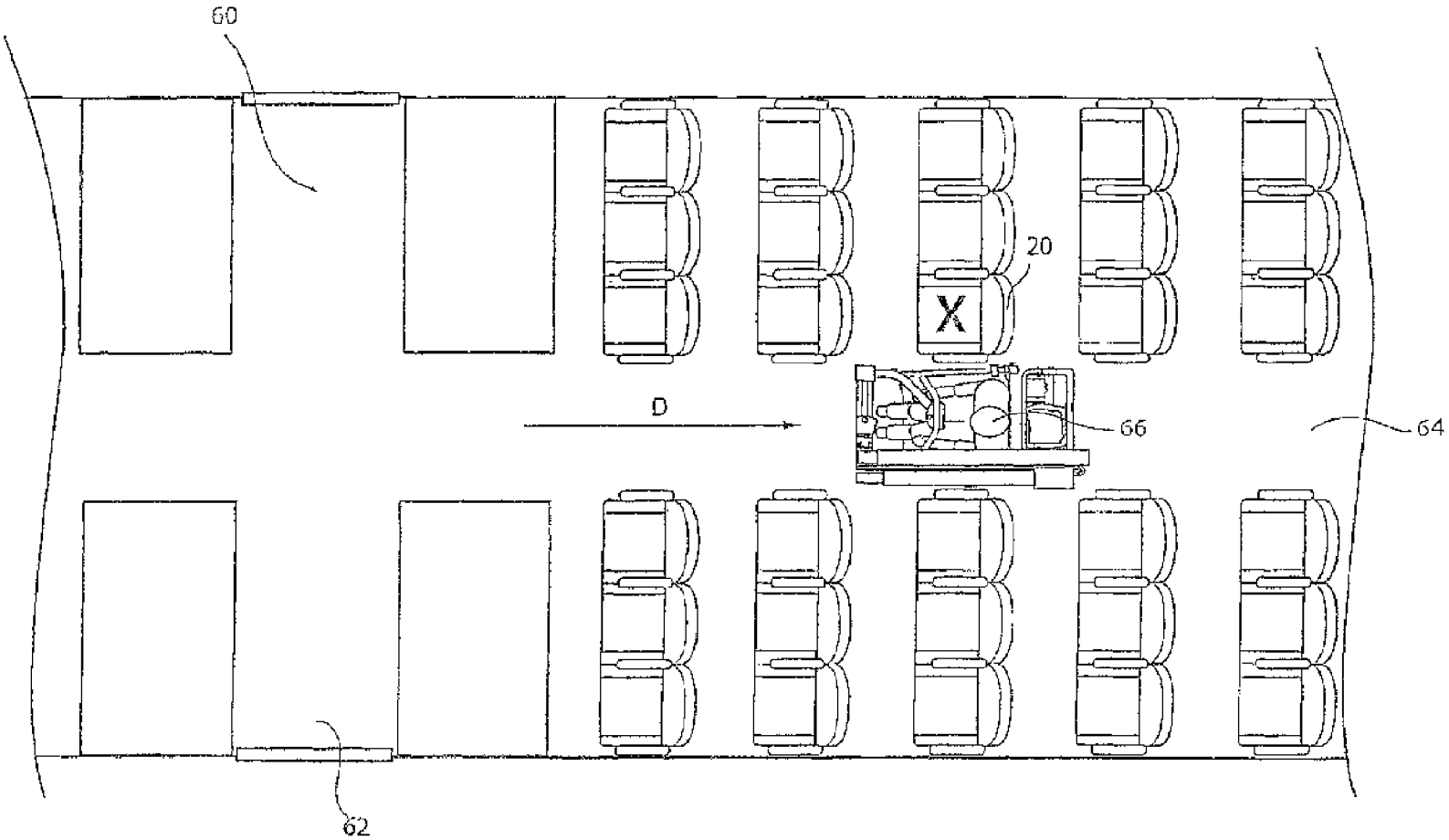

The apparatus 10 is now ready to be wheeled (backwards) along the seating aisle 64 in the direction of arrow D (shown in FIG. 8).

Figure 9:
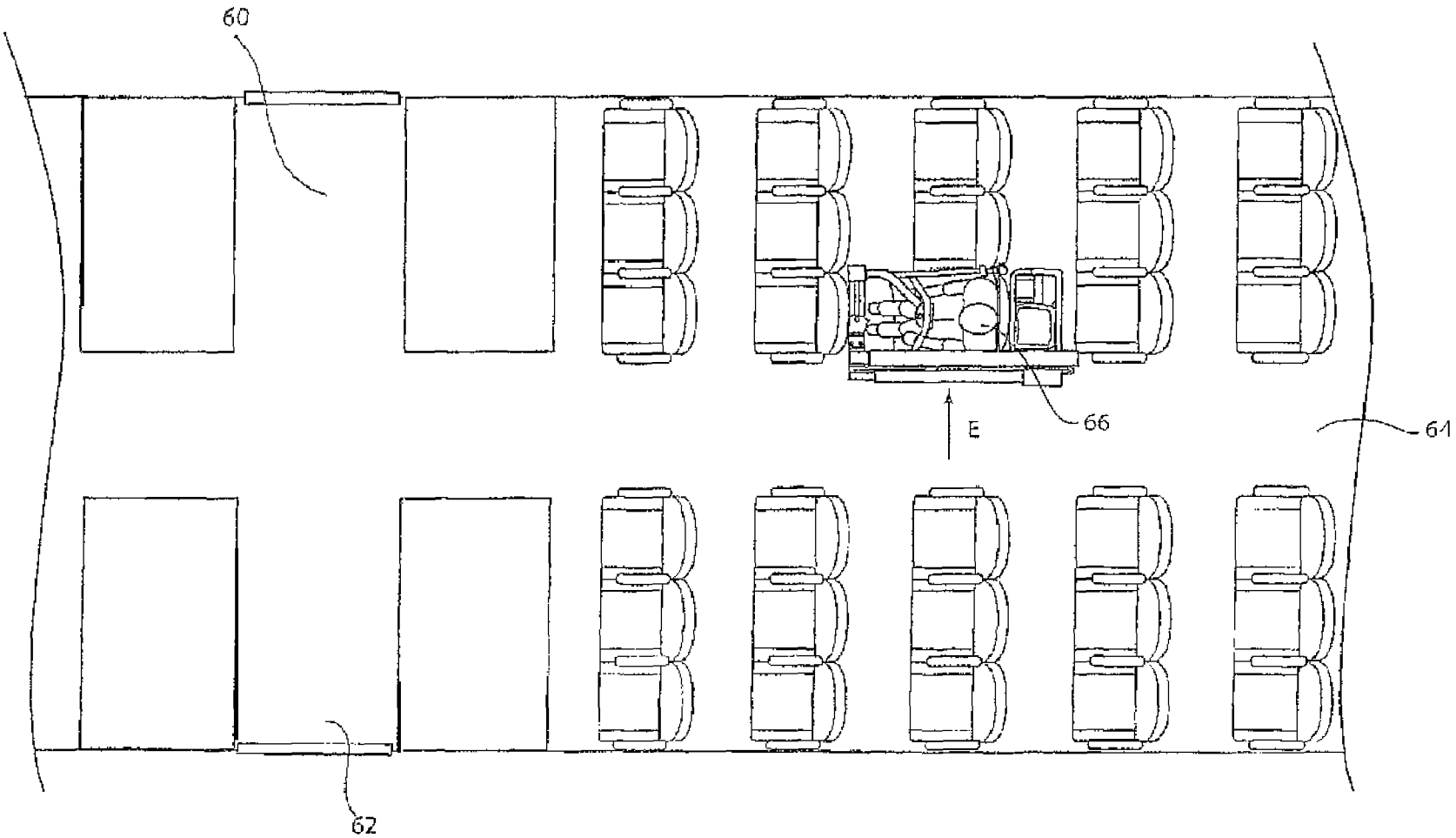

In FIG. 8, the apparatus 10 has been wheeled down the seating aisle 64 to a position adjacent the person's assigned fixed seat 20. The front leg 12 is aligned between the fixed seat 20 and the back of the seat in front, and the rear leg 14 is aligned between the back of the fixed seat 20 and the seat behind. The apparatus 10 is then wheeled sideways in the direction of arrow E so as to span the fixed seat 20, locating the person 66 (in the transfer seat 24) directly above their assigned fixed seat 20 as can be seen in FIG. 9. With the front leg 12 being off-set in the apparatus 10, the front leg 12 will not be directly in front of the fixed seat 20 but will be generally aligned with the left hand edge of the fixed seat 20, close to the seating aisle 64, leaving an open space adjacent to the front leg 12 of the apparatus 10 in front of the fixed seat 20.

The lifting device is then operated to lower the person 66 into their assigned fixed seat 20, again ideally lowering them vertically without any movement forward, backwards or to the side.

Figure 10:
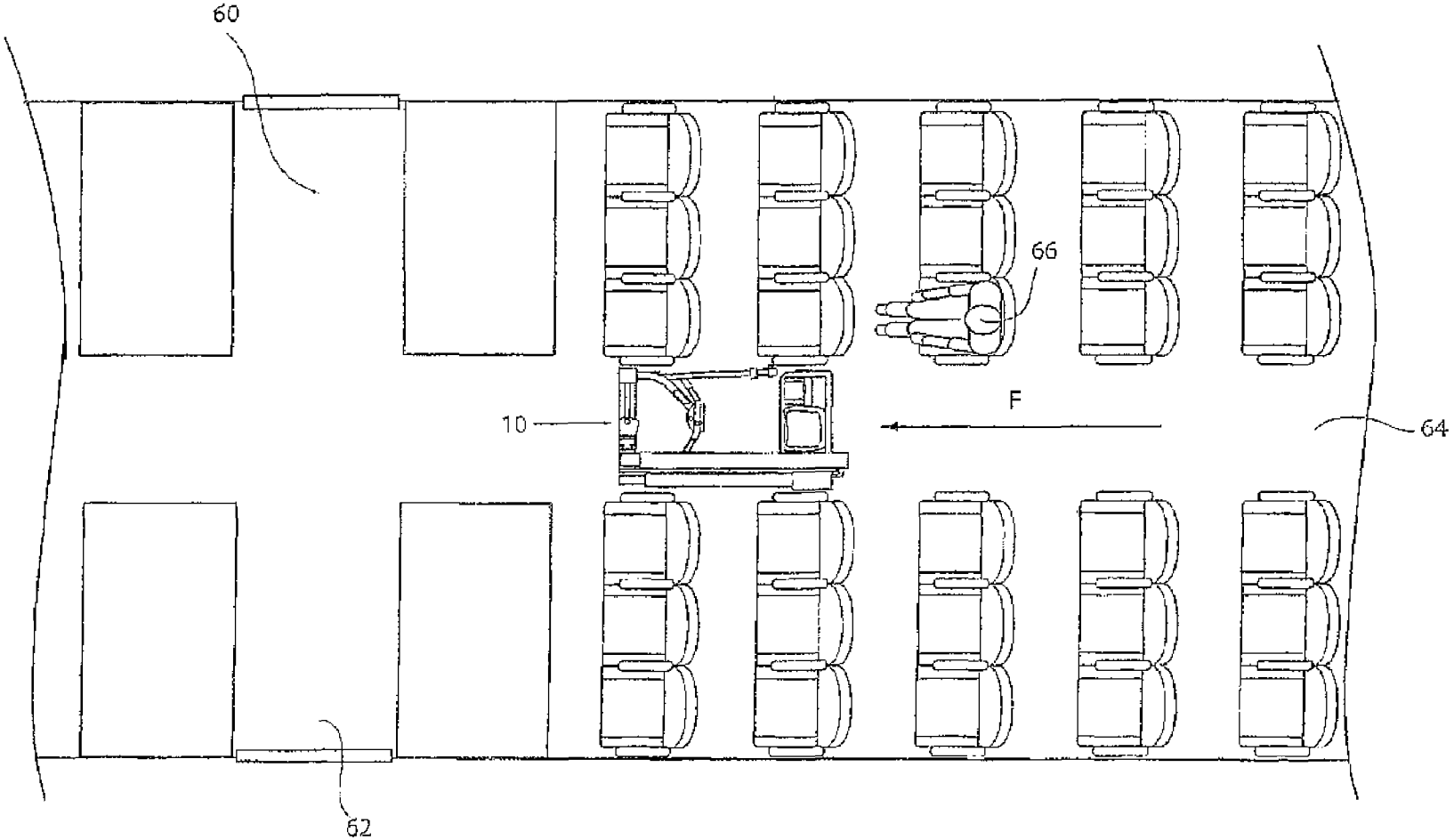

After removing the transfer seat 24 from under the person 66, the apparatus 10 can then be removed from its position spanning the fixed seat 20 (by moving it in a direction opposite to arrow E), and then returned to the galley 60 of the aircraft along the seating aisle 64 in the direction of arrow F in FIG. 10.

The reverse transfer of a person from their fixed seat 20 back to a wheelchair 66 of course merely takes place in the reverse order to that described above for transferring them to the fixed seat 20. In this respect, it should be appreciated that this specification has not endeavoured to introduce the somewhat clumsy language of 'transferring a person to/from a wheelchair', leaving it to the understanding of a skilled addressee that of course the apparatus can be operated to transfer a person either from or to a wheelchair either to or from a fixed seat.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for transferring a person from a wheelchair to a fixed seat, the apparatus including:

(a) a wheeled gantry that includes opposed, generally upright, front and rear legs and an upper portion connecting the legs, the front and rear legs defining therebetween a transfer station that has a side entry for the wheelchair, the front and rear legs also being capable of, in use, receiving therebetween the fixed seat; and (b) a holding apparatus including a transfer seat and a transfer seat support frame, the transfer seat having a vertical axis, and being sized to fit, in use, within the fixed seat;

wherein the apparatus also includes a lift device for raising and lowering the transfer seat along its vertical axis without lateral movement off the vertical axis, and means for rotating the transfer seat support frame within the transfer station.

2. Apparatus according to claim 1, wherein the lift device includes a guided member adapted to move up and down the front leg to thereby raise and lower the transfer seat.

3. Apparatus according to claim 2, wherein the guided member includes a motorized actuator connected to a sleeve that is slideable up and down the front leg.

4. Apparatus according to claim 1 wherein the transfer seat support frame includes spaced apart side members configured to support therebetween and therebelow the transfer seat.

5. Apparatus according to claim 4 wherein the side members are elongate and are connected via a transverse member at a central location on each side member, the ends of the side members supporting therebetween and therebelow the transfer seat.

6. Apparatus according to claim 1, wherein the holding apparatus is connected to the lift device via a support arm.

7. Apparatus according to claim 6 wherein the lift device includes a guided member adapted to move up and down the front leg to thereby raise and lower the transfer seat, the guided member including a sleeve that is slideable up and down the front leg, and the support arm is rigidly connected to the sleeve of the guided member.

8. Apparatus according to claim 6 wherein the lift device includes a guided member adapted to move up and down the front leg to thereby raise and lower the transfer seat, the guided member including a sleeve that is slideable up and down the front leg, and the support arm is pivotally connected to the sleeve of the guided member to allow movement of the transfer seat axis within the transfer station, towards or away from the front leg.

9. Apparatus according to claim 6, wherein the connection of the support arm to the holding apparatus permits rotation of the transfer seat support frame within the transfer station.

10. Apparatus according to claim 9 wherein the transfer seat support frame includes spaced apart side members configured to support therebetween and therebelow the transfer seat, the side members being elongate and connected to each other via a transverse member at a central location on each side member, the ends of the side members supporting therebetween and therebelow the transfer seat, and wherein the support arm is connected to the transverse member of the transfer seat support frame, in a manner that permits rotation of the transfer seat support frame within the transfer station.

11. Apparatus according to claim 9 wherein the rotation of the transfer seat support frame is such that the transfer seat rotates from a wheelchair entry position through about 90° to a fixed seat transfer position, and vice-versa.

12. Apparatus according to any claim 1 wherein the transfer seat is detachable from the transfer seat support frame.

13. Apparatus according to claim 1 wherein the front leg is a single upright member off-set so as to provide an open space in front of the transfer seat during operation.

14. Apparatus according to claim 1 wherein the rotation of the transfer seat support frame within the transfer station occurs about the vertical axis of the transfer seat.

15. Apparatus according to claim 1 wherein the transfer seat is a sling.

16. Apparatus according to claim 1 wherein the fixed seat is an aircraft seat.

17. A method for transferring a person from a wheelchair to a fixed seat, using the apparatus of claim 1, the method including the steps of:

(a) wheeling the wheelchair into the transfer station via the side entry;

(b) raising the person out of the wheelchair in the transfer seat;

(c) removing the wheelchair from the transfer station;

(d) rotating the transfer seat so that the person faces the front;

(e) moving the wheeled gantry to span the fixed seat;

(f) lowering the person into the fixed seat and removing the transfer seat; and (g) withdrawing the wheeled gantry from spanning the fixed seat, wherein steps (a) and (b) occur without rotating the wheelchair with respect to the gantry.

18. A method according to claim 17 wherein the transfer seat is detached from the holding apparatus and the person is placed in the transfer seat whilst still in the wheelchair and before step (b), the transfer seat being re-attached to the holding apparatus after step (a).

19. A method according to claim 17 wherein the fixed seat is an aircraft seat, the aircraft having an entrance aisle and a seating aisle, the gantry being located in the seating aisle with the side entry of the transfer station directly accessible by a wheelchair wheeled along the entrance aisle.

* * * * *

UNITED STATES PATENT AND TRADEMARK OFFICE

CERTIFICATE OF CORRECTION

PATENT NO. : 7,996,934 B2
APPLICATION NO. : 12/820471
DATED : August 16, 2011
INVENTOR(S) : William Hay It is certified that error appears in the above-identified patent and that said Letters Patent is hereby corrected as shown below:

Column 1, line 41, “aisle chair’” should read --“aisle chair”--.
Column 1, line 57, delete “though”.
Column 2, line 19, following “above” delete “,”.
Column 11, line 10, delete “has” and insert therefor --have--.
Column 11, line 12, “show” should read --shows--.
Column 11, line 49, following “to” insert --be--.
Column 12, line 1, “persons” should read --person’s--.
Column 14, line 6, delete “any”.

Signed and Sealed this
Fourth Day of September, 2012

David J. Kappos

David J. Kappos
*Director of the United States Patent and Trademark Office*